United States Patent [19]

Mills et al.

[11] 3,959,122

[45] May 25, 1976

[54] MAKING A WHITE OIL BY HYDROGENATION WITH A SULFIDED NICKEL AND MOLYBDENUM CATALYST

[75] Inventors: Ivor W. Mills, Media; Glenn R. Dimeler, West Chester, both of Pa.

[73] Assignee: Sun Oil Company of Pennsylvania, Philadelphia, Pa.

[22] Filed: Sept. 30, 1974

[21] Appl. No.: 510,527

Related U.S. Application Data

[60] Division of Ser. No. 228,832, Feb. 24, 1972, Pat. No. 3,839,189, and a continuation-in-part of Ser. Nos. 622,398, March 13, 1967, Pat. No. 3,462,358, Ser. No. 652.026, July 10, 1967, Pat. No. 3,502,567, Ser. No. 730,999, May 22, 1968, Pat. No. 3,839,188, Ser. No. 850,716, Aug. 18, 1969, abandoned, Ser. No. 850,717, Aug. 18, 1969, abandoned, Ser. No. 873,008, Oct. 31, 1969, abandoned, Ser. No. 22,295, March 24, 1970, Pat. No. 3,681,233, Ser. No. 165,006, July 22, 1971, Pat. No. 3,804,743, Ser. No. 165,141, July 22, 1971, Pat. No. 3,759,817, and Ser. No. 175,775, Aug. 27, 1971, abandoned.

[52] U.S. Cl. ..... 208/143; 208/14; 208/254 H; 208/264

[51] Int. Cl.[2] ..... C10G 23/02

[58] Field of Search ..... 208/14, 18, 143, 210, 208/264

[56] References Cited

UNITED STATES PATENTS

| | | | |
|---|---|---|---|
| 3,224,955 | 12/1965 | Anderson | 208/28 |
| 3,340,181 | 9/1967 | Diringer et al. | 208/210 |
| 3,392,112 | 7/1968 | Bercik et al. | 208/210 |
| 3,462,358 | 8/1969 | Mills et al. | 208/14 |

*Primary Examiner*—Herbert Levine
*Attorney, Agent, or Firm*—J. Edward Hess; Donald R. Johnson; Paul Lipsitz

[57] ABSTRACT

A technical grade white oil of low UV absorptivity is made by the hydrogenation of a paraffinic distillate under specified conditions.

2 Claims, 3 Drawing Figures

FIGURE 3
EFFECT OF HYDROGENATION TEMPERATURE ON UV ADSORPTIVITY.

FIGURE I

TOTAL NITROGEN AND BASIC NITROGEN VS ULTRAVIOLET ABSORPTIVITY FOR NAPTHENIC OILS OF DIFFERING VISCOSITY (AT 100° F)

BASIC NITROGEN CONTENT VS ACID ACTIVATED CLAY DOSAGE

EFFECT OF HYDROGENATION TEMPERATURE ON UV ADSORPTIVITY.

MAKING A WHITE OIL BY HYDROGENATION WITH A SULFIDED NICKEL AND MOLYBDENUM CATALYST

CROSS REFERENCE TO RELATED APPLICATIONS

This is a division of application Ser. No. 228,832, filed Feb. 24, 1972 now U.S. Pat. No. 3,839,189 and the present application is a continuation-in-part of all of the following earlier filed applications of the present inventors:

| Serial No. | Filing Date | Patent No. | Issue Date | Title |
|---|---|---|---|---|
| 622,398 | 3-13-67 | 3,462,358 | 8-19-69 | Clay Treatment of Hydrorefined Cable Oils |
| 652,026 | 7-10-67 | 3,502,567 | 3-24-70 | Process for Producing Cable Oils by Sequential Refining Steps |
| 730,999 | 5-22-68 | 3,839,188 | 10-1-74 | Hydrorefined Transformer Oil and Process of Manufacture |
| 850,716 | 8-18-69 | abandoned | 9/29/71 | Blended Hydrocarbon Oil and Process of Manufacture |
| 850,717 | 8-18-69 | abandoned | 3/3/72 | Hydrorefined Lube Oil and Process of Manufacture |
| 873,008 | 10-31-69 | abandoned | 12/14/73 | Oil and Process of Manufacture of Blended Hydrorefined Oil |
| 22,295 | 3-24-70 | 3,681,233 | 8-1-72 | Hydrorefined Cable Oil and Process of Manufacture |
| 165,006 | 7-22-71 | 3,804,743 | 4-16-74 | Process for Producing Blended Petroleum Oil |
| 165,141 | 7-22-71 | 3,759,817 | 9-18-73 | Blend Comprising Hydrorefined Oil and Raw Distillate |
| 175,775 | 8-27-71 | abandoned | 10-4-75 | Blended Hydrocarbon Oil and Process of Manufacture |

RELEVANT PATENTS AND PUBLICATIONS

In parent application Ser. No. 850,717, filed Aug. 18, 1969 now abandoned, the following references were cited:

| Patent No. | Issue Date | Patentee | Class/Sub |
|---|---|---|---|
| U.S. 2,288,373 | 6/42 | Smith et al | 208/14 |
| U.S. 3,224,955 | 12/65 | Anderson | 208/18 |
| U.S. 3,328,293 | 6/67 | Brenken | 208/143 |
| U.S. 3,369,999 | 2/68 | Donaldson et al | 208/264 |
| U.S. 3,462,358 | 8/69 | Mills et al | 208/14 |
| Canada 743,525 | 9/66 | Cibula et al | 208/14 |

Publication: Von Hippel "Dielectric Materials and Applications" pp. 156–160, Wiley and Sons, London (1961).

Other relevant references are the following:

U.S. Pat. No. 3,232,863 to Watson

U.S. Pat. No. 3,425,932 to Surrena et al

U.S. Pat. No. 3,459,656 to Rausch and *Petroleum Products Handbook*, Guthrie, McGraw, Hill. Also of interest is Canadian Pat. No. 714,533, issued July 27, 1965 (Class 196-60) of Kozlowski et al., which refers to the total nitrogen contents of certain hydrorefined oils; however, Kozlowski et al. fail to appreciate that additional refining of said oils to remove basic nitrogen can be advantageous (as is discussed in greater detail hereinafter.)

BACKGROUND OF THE INVENTION

In copending application Ser. No. 622,398, now U.S. Pat. No. 3,462,358, a process is claimed for producing an improved cable oil having an ASTM D-1934 aged dissipation factor (ADF) below 0.010 in the absence of added oxidation inhibitors, from a hydrogenated naphthenic oil having a viscosity in the range of 500–2000 SUS at 100°F., an untraviolet absorbency (UVA) less than 8 at 260 millimicrons and having an ADF greater than 0.015, comprising contacting said oil at a temperature in the range of 100°–400°F., with an adsorbent comprising an acid-activated adsorbent clay in an amount per barrel of oil such that from 10–90 grams of KOH would be required to neutralize the acidity of the acid-activated adsorbent clay. Also claimed is a naphthenic electrical oil having a viscosity in the range of 500–2000 SUS at 100°F., having an ADF less than 0.010 in the absence of added oxidation inhibitors, and which requires at least 75 hours at PFVO test conditions to reach a 6% power factor. It was further disclosed that, in the case of the high viscosity cable oils (4000–6000 SUS at 100°F.), a relatively inexpensive fuller's earth bleaching clay was preferred as the adsorbent for such a hydrorefined oil and that the dosage of clay was not particularly critical insofar as the ADF of the resulting cable oil was concerned.

Also disclosed were hydrogenation conditions and catalysts which could be used to severely hydrorefine distillate oils in the lubricating oil viscosity range (35 and higher SUS at 100°F.). It was further disclosed that such severe hydrogenation should be conducted so that the 260 UVA of the feed to the hydrogenation step be reduced at least 40%.

Further disclosed in said application, by example, was that the degree of nitrogen removal caused by the severe hydrorefining can vary according to the viscosity of the charge oil (an oil having a viscosity of 107 SUS and containing 190 p.p.m. N produced an oil container 47 p.p.m. N; whereas, an oil having a viscosity of 2901 SUS and containing 467 p.p.m. of N produced, under the same hydrogenation conditions, an oil containing 313 p.p.m. of N).

BRIEF SUMMARY OF THE INVENTION

It has been discovered that, in hydrorefined lubes having viscosities of 100 SUS or higher at 100°F. (whether paraffins, naphthenic or aromatic), the total nitrogen content is not a reliable indicator of the stability of the oil under all conditions of use (as with refrigeration oils, textile oils, electrical oils, transmission fluids, etc.), but that the "basic" nitrogen content of the hydrogenated oil is an important indicator of how the oil (or blends containing the oil) will respond under severe conditions of use. In severely hydrorefined oils (as defined herein), the basic nitrogen content becomes a greater problem as the viscosity increases. It is a severe problem in oils of about 150 SUS and very severe in oils of 500 SUS or greater.

A novel hydrorefined oil of improved stability under severe conditions of use has a viscosity in the range of 150–12,000 SUS at 100°F., (typically, 500 SUS-6000 SUS), contains 10–44% gel aromatics and less than 10 p.p.m. (preferably less than 5 p.p.m., more preferably less than 2 p.p.m.) of basic nitrogen. Typically, such an oil can contain more than 10 p.p.m. of total nitrogen (e.g., 15–600 p.p.m.) depending on the viscosity of the oil and the severity of the hydrorefining. Preferably, the hydrorefined oil is naphthenic or aromatic by VGC classification; that is, it has a viscosity-gravity constant in the range of 0.820–0.94, or greater, (typically, 0.84–0.92).

The basic nitrogen in such severely hydrorefined lube oils (typically 15–400 p.p.m.) can be reduced to less than 10 p.p.m. by a process comprising contacting the hydrorefined oil with an acidic adsorbent (such as an adsorbent comprising an acid-activated clay), preferably at 50°–150°F., or by contacting the hydrorefined oil with sufficient quantities of a mineral acid (e.g., 90–120% $H_2SO_4$) followed by a basic wash to neutralize the oil and remove impurities (as by the procedures referred to in application Ser. No. 657,438 of Schneider and Stuart). More preferably, the contacting is at a temperature in the range of 50°–100°F (e.g., 70°F).

The oil which has been acid contacted and neutralized can be further finished (as may be desired for an electrical oil) by adsorbent contacting, as with a fuller's earth bleaching clay (attapulgite), activated carbon, alumina, or a crystalline alumino-silicate zeolite (e.g., Linde 5A, or 13X molecular sieves), an acid-activated clay or combinations of two or more such adsorbents (e.g., see U.S. Pat. No. 3,369,993). A preferred adsorbent combination is an admixture of attapulgite and acid-activated clay.

FURTHER DESCRIPTION OF THE INVENTION

Petroleum fractions (e.g., distillates, extracts, raffinates, reformer bottoms, cycle oil fractions, etc.) in the lubricating oil viscosity range (35–12,000 SUS at 100°F.) can be severely hydrorefined (e.g., at 600°F., 1200 p.s.i.g. of 80% hydrogen, 0.3 LHSV, presulfided Ni-Mo oxide catalyst) to produce a hydrogenated oil having a lighter ASTM color, a lower (by at least 40%, typically 40–90%) ultraviolet absorptivity at 260 millimicrons and containing appreciably less total nitrogen (and, if desired, lower gel aromatics) than was in the charge to the hydrorefining stage.

With some charges, such as paraffinic distillates, dewaxing and/or deasphalting can be advantageous prior to hydrorefining. Preferably, to insure longer catalyst life and to reduce hydrogen consumption, when the petroleum fraction is derived from a stock containing naphthenic acids, such acids should be removed (or substantially reduced) prior to hydrorefining as by the processes disclosed in the following U.S. Pat. Nos.: 1,603,174; 2,770,580; 2,795,532; 2,966,456 and 3,080,312.

In the case of light lubes (e.g., having a viscosity in the range of 35–65 SUS at 100°F.), such as the transformer oils, the total nitrogen remaining in the oil after a single stage of severe hydrogenation can frequently be less than 10 p.p.m. (typically, less than 5 p.p.m.). Hydrorefining can also be conducted (in a single stage or in multiple stages) so as to obtain a hydrorefined (or hydroaromatized) oil with such low nitrogen and an increased gel aromatic content (e.g., see Ser. No. 636,493 now U.S. Patent No. 3,681,279).

Therefore, in light lubes and, particularly, in transformer oils, severe hydrogenation in a single stage is normally sufficient to reduce the basic nitrogen to less than 5 p.p.m. Generally, basic nitrogen is not a problem in such severely hydrorefined light lubes. Similarly, when the charge to a severe hydrorefining stage consists essentially of a paraffinic distillate in the lubricating oil boiling range, severe hydrogenation in a single stage is usually sufficient to effectively reduce both total and basic nitrogen to less than 10 p.p.m.

Figure 1:
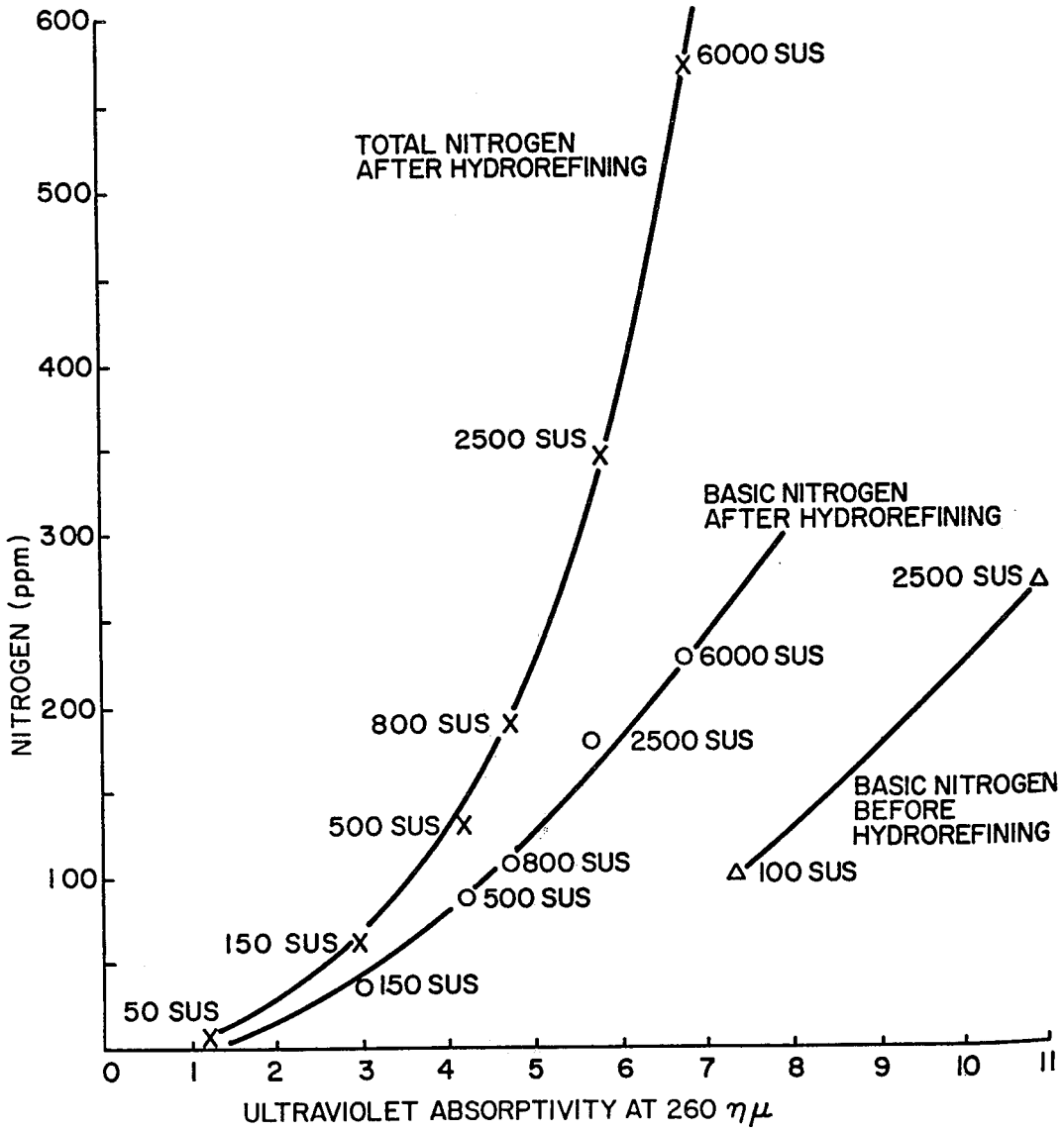
FIG. 1 is a plot of the 260 UVA versus the nitrogen content (total or basic) of hydrorefined naphthenic oils of various viscosities. The hydrorefining of each charge oil was at 650°F., 0.5 LHSV (of the fresh feed), 1200 p.s.i.g. of 75% hydrogen (at the reactor inlet) with sulfided NiMo oxides on alumina as the catalyst. Also plotted is the basic nitrogen content of the charge stock (in the 100–2500 SUS viscosity range) before hydrorefining.

However, as is illustrated in FIG. 1 in the drawings attached hereto, when the charge stock is a naphthenic or aromatic distillate (including a raffinate or extract product from solvent extraction of a naphthenic distillate), having a viscosity greater than about 100 SUS, (typically 150–12,000 SUS) severe hydrogenation in a single stage, as to an untraviolet absorptivity at 260 millimicrons (i.e., 260 UVA) in the range of 3 for a 150 SUS oil, cannot economically be used to reduce the basic nitrogen content below about 10 p.p.m., nor the total nitrogen content below about 20 p.p.m. As can be seen from FIG. 1, both the total and the basic nitrogen contents of such hydrorefined oils typically are greater as the viscosity of the oil increases. This is probably due to less efficient utilization of the hydrogen caused by the hindering effect of the larger oil molecules on hydrogen diffusion.

Figure 2:
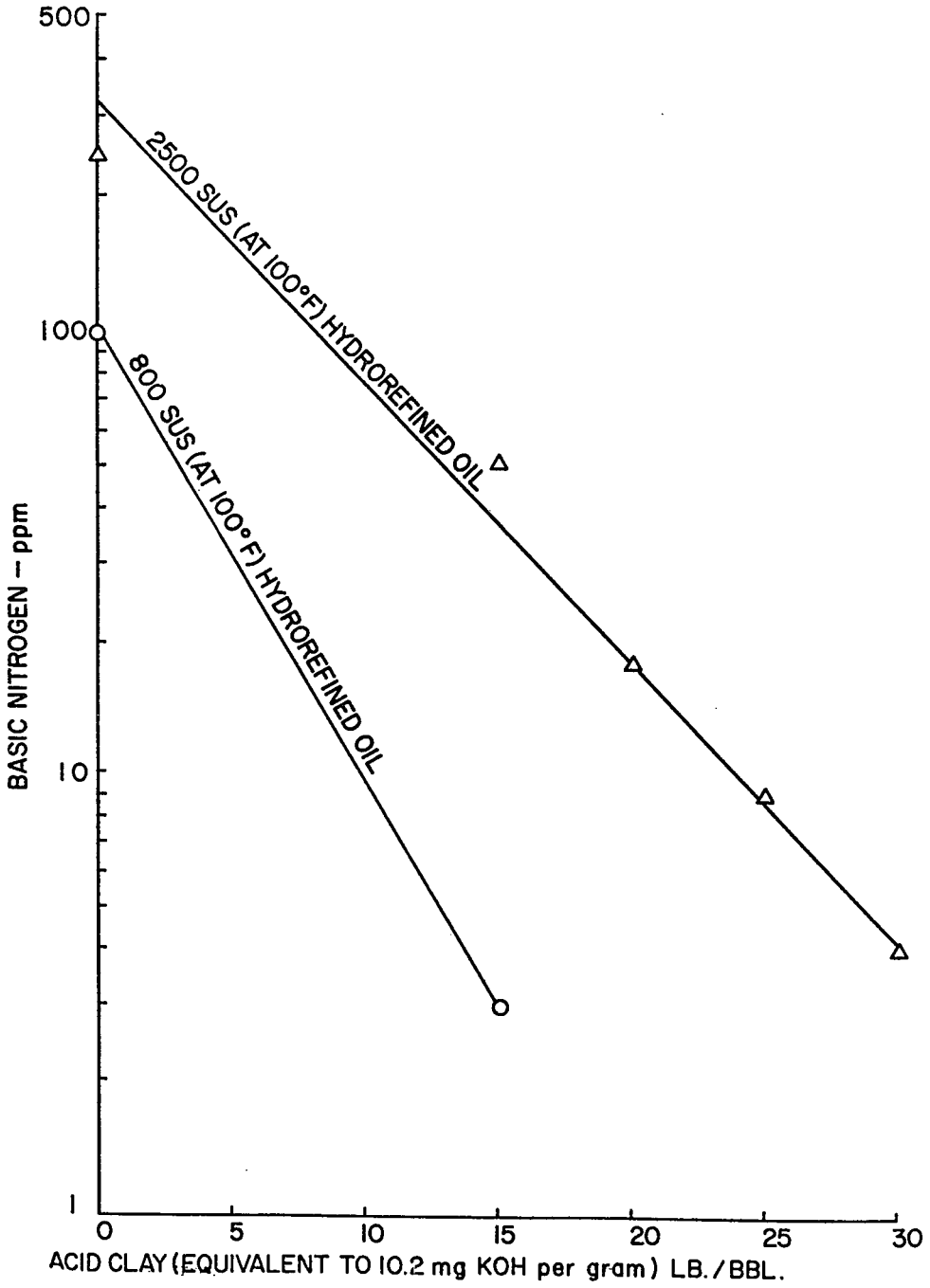
FIG. 2 is a plot of the pounds of acid-activated clay (equivalent to 10.2 mg KOH per gram) required per barrel of hydrorefined oil to reduce the basic nitrogen to a given p.p.m. level in two of the severely hydrorefined naphthenic distillates from which the data plotted in FIG. 1 was obtained. The basic nitrogen is on a logarithmic scale, indicating that at lower concentrations it becomes increasingly more difficult to remove basic nitrogen with a single contacting step.

Also shown, in FIG. 2 is the dramatic degree to which such basic nitrogen can be removed from such a hydrorefined oil be means of an acidic adsorbent, particularly, acid-activated adsorbent clay.

For many uses (as in dark colored rubber vulcanizates or in electrical cables where the oil is not in contact with Kraft paper) such severely hydrorefined oils exhibit satisfactory performance even at total nitrogen levels in the range of 30–900 p.p.m. (about 50% of the total nitrogen being "basic" nitrogen). For certain end uses (such as in textile spinning oils, light colored oil-rubber vulcanizate, cables where the oil is in contact with Kraft paper and in refrigerator oils subjected to high operating temperatures) a much more satisfactory performance is obtained with a hydrorefined oil which has a viscosity in the range of 100–12,000 SUS at 100°F., contains 5–50% (typically 20–44%) of gel aromatics, and contains less than 10 p.p.m. of basic nitrogen (preferably, less than 5 p.p.m. and more preferred less than 2 p.p.m.).

The phrase "total nitrogen" refers to the nitrogen content of an oil as determined by such methods as that of P. Gouverneur, *Anal. Chim. Acta, 26* (1962) 212 or, more preferred, the modified Gouverneur method described by Smith, A. J. et al. in *Anal. Chim. Acta, 40* (1968) 341–343.

The phrase "basic nitrogen" refers to those nitrogen compounds present in crudes, petroleum distillates and residues which have a basic ionization constant, $K_b$, greater than $1\text{-}^{-12}$. A preferred analytic method for determining the content of such basic nitrogen compounds in hydrorefined oils in the lube oil viscosity range, involves dissolving a sample of the oil in an appropriate solvent and potentiometrically titrating the solution with perchloric acid in acetic acid. In the case of light-colored oils, the solvent can be glacial acetic acid and para-naphthol-benzein can be used as a colormetric indicator as an alternative to the potentiometric procedure. Dark samples and heavier oils are dissolved in chlorobenzeneacetic acid solvent and titrated potentiometrically (utilizing a pH meter or its equivalent and a glass-calomel electrode system).

For the potentiometric titration, the procedure is to place a 20 gram sample of the oil in a 250 ml. tall-form titration beaker and add about 100 milliliters of a mixture of equal quantities of glacial acetic acid and chlorobenzene. The sample is then titrated potentiometrically, at room temperature, while being stirred continually by a magnetic stirrer, with 0.01 N perchloric acid in glacial acid to which has been added about 20 ml. of acetic anhydride for each liter of glacial acetic acid (in order to insure the removal of any water that might be present). The weight percent basic nitrogen is calculated as follows:

$$\text{PPM Basic } N = \frac{(V_1 - V_2)(N)(0.014)\,10^6}{W}$$

Where:

$V_1$ = ml titrant for sample
$V_2$ = ml titrant for blank
N = normality of perchloric acid
W = sample weight (grams)

This potentriometric titration can be used to determine the basic nitrogen content of a hydrorefined oil in the range of 1 to at least 2000 p.p.m. and, in the range of 1–10 p.p.m. is at least accurate to within 1 p.p.m. when corrections are made for interferences by hydroxides, some oxides, carbonates, naphthenates, and similar bases (if these are present in the sample).

The phrases "severe hydrorefining" or "hydrogenation" refer to processes conducted in the presence of a hydrogenation catalyst at from about 500°–775°F., with hydrogen of 50–100% purity, and from 800–3000 p.s.i. of hydrogen at the reactor inlet (at total pressures from 800–6000 p.s.i.g.) at a fresh feed liquid hourly space velocity (LHSV) of from 0.1–8.0 (usually below 2.0), preferably conducted either in vapor phase or trickle phase. Such hydrogenation or severe hydrorefining is to be distinguished from hydrocracking in that the production of "overhead" (i.e., hydrocarbons boiling below 485°F.) is less than 25% by volume per pass through the reactor (and, typically, less than 10%). Product recycle, for example, as in U.S. Pat. No. 2,900,433, can be used to increase severity. Recycle liquid hourly space velocity can vary from 0 to 20; however, we prefer to operate at total liquid throughputs that obtain at greater than 25% of flooding velocity and more preferably at from 40–98% of flooding velocity.

Preferably, the temperature is below that at which substantial cracking occurs, that is, no more than 20 weight precent (preferably less than 10%) of the feed stock is converted to material boiling below 300°F. in a single pass through the reactor. Although the maximum hydrogenation temperature which will not produce substantial cracking is somewhat dependent upon the space velocity, the type of catalyst and the pressure, generally it is below 750°F. but can be as high as 785°F. To allow a margin of safety, we prefer to operate below 700°F. (except when it is desired to obtain a hydrogenated oil containing more gel aromatics than are in the charge). At total pressures below about 2000 p.s.i. we prefer a temperature below about 660°F., since above that temperature the degradation of oil viscosity can become large.

Typical of such severe hydrorefining methods, when conducted within the aforementioned processing conditions, are those of U.S. Pat. Nos. 2,968,614; 3,993,855; 3,012,963; 3,114,701; 3,144,404; and 3,278,410; and those of the previously referred to copending applications, Ser. Nos. 622,398; 652,026; 636,493 now U.S. Pat. No. 3,681,279; 730,999 and 812,516 now U.S. Pat. No. 3,619,414. The terms "severely hydrorefined oil" or "hydrogenated oil" include the products, within the lubricating oil boiling range, of such severe hydrorefining or hydrogenation. One characteristic of a severely hydrorefined or hydrogenated oil is that the ratio of monocyclic aromatics to polycyclic aromatics is significantly greater than in hydrotreated oils or conventional distillate oils.

Where the desired hydrorefined oil is to be of the naphthenic class, a preferred charge to the hydrogenation reactor can be obtained by vacuum distillation of naphthenic or "mildly aromatic" crude oils (as in U.S. Pat. No. 3,184,396), especially those crude oils wherein the 1500–3000 SUS (at 100°F.) distillate fractions have viscosity-gravity constants from 0.84 to 0.92. Preferably, such a charge stock should be substantially free of naphthenic acids prior to the hydrorefining (thus, in some cases distillation in the presence of caustic is advantageous). Usually materials boiling below about 600°F. (including residual $H_2S$, $NH_3$, etc.) are removed from the hydrorefined oils, as by atmospheric distillation (and the viscosity can also be adjusted by choice of distillation end point) prior to clay contacting (if the oils are to be clay finished).

The viscosity of the base oil, or of the final hydrorefined oil, can be adjusted by the addition of other oils of higher or lower viscosity and which are within the lube oil boiling range. For example, a preferred cable oil having a viscosity at 100° F. in the range of 500–2000 SUS with hydrogenated oil having a viscosity from 1500–3000 SUS and then contacting the resulting blend of hydrogenated oils with sufficient acidic adsorbent or mineral acid to reduce the basic nitrogen content of the oil to below 10 p.p.m.

By naphthenic distillate, we refer to a distillate fraction (or a mildly acid treated distillate fraction, or a solvent raffinate fraction or an acid-treated raffinate) usually from vacuum distillation, of a crude which is classified as naphthenic (including "relatively naphthenic") by the viscosity-gravity constant (VGC) classification method. Preferably, such crudes are "Grade A" (wax-free), typically Gulf Coastal, and include, for example, Refugio, Mirando, and Black Bayou. The lower VGC oils can be obtained from mid-continental crudes; however, dewaxing may be necessary (as by extraction or isomerization) for end uses where the final oil is required to have a low pour point (e.g., less than 30°F.). Such naphthenic fractions will have a VGC in the range of 0.820 to 0.899 and, typically, a viscosity in the range of 150–12,000 SUS at 100°F. (for example, 500–6000). In some cases the crude (and distillate) can have a VGC as high as 0.94 (such crudes are characterized as "mildly aromatic"), or higher (e.g., $0.96^{+}$). Deep furfural extraction (e.g., about 50% yield) of a high VGC Grade A crude can be used to produce a wax-free, lower VGC fraction (e.g., 0.83 VGC) which can be used in low floc point (or pour point) blends with paraffinic oils (e.g., see Ser. No. 200,185). Paraffinic oils are those oils having a VGC of 0.819 or less and also having an ASTM viscosity index of 65 or more.

FURTHER DESCRIPTION OF THE DRAWINGS

FIG. 1 herein illustrates the typical contents of total nitrogen and basic nitrogen for severely hydrorefined naphthenic oils in the viscosity range from 50 to over 6000 SUS. The curves can be extended (either by mathematical means or by use of a French curve), to obtain typical nitrogen contents of oils as high as 12,000 SUS at 100°F.

In FIG. 1, two curves have been drawn to illustrate the relationship between the total and basic nitrogen content of severely hydrorefined oils of a number of viscosity ranges. The nitrogen content has been plotted against the 260 UVA, since the 260 UVA indicates the degree to which the oils have been hydrogenated. Also illustrated in a third curve is the basic nitrogen content of the charge oils before hydrorefining.

For example, in FIG. 2, a 250 SUS naphthenic distillate (which was substantially free from naphthenic acid) was hydrorefined at 650°F., 0.5 LHSV at 1200 p.s.i.g. of 80% hydrogen (at the reactor inlet). The 2500 SUS oil contained about 270 p.p.m. of basic nitrogen before the hydrorefining. The hydrorefined oil contained about 180 p.p.m. of nitrogen (and about 350 p.p.m. total nitrogen). The UVA of the 2500 SUS distillate before hydrorefining was about 10.8 and, the hydrorefined oil had a 260 UVA of about 5.6, indicating a severe hydrogenation for such a relatively highly viscous distillate.

FIG. 2 of the drawings illustrates the degree to which the basic nitrogen in a hydrorefined oil can be reduced by contacting the oil with an acid clay. In the figure, the acid clay used had an acidity equivalent to 10.2 mg KOH per gram. In FIG. 2, the basic nitrogen is plotted on a logarithmic scale, indicating that as the lower levels of nitrogen content are approached, it becomes progressively more difficult to remove basic nitrogen with the acid clay adsorbent. The two curves in FIG. 2 illustrate that as the viscosity of the hydrorefined oil increases, greater amounts of acid clay are necessary to reduce the basic nitrogen content to less than 10 p.p.m. (and, or more preferably to less than 5 p.p.m.). With the more highly viscous, hydrorefined oils, it becomes more economical to utilize a mineral acid, and to dilute the oils with a non-reactive, less viscous, lower boiling solvent (such as iso-octane or gas oil).

ILLUSTRATIVE EXAMPLES

Example I

A 2500 SUS naphthenic distillate (which was substantially free from naphthenic acid) was hydrorefined at 650°F., 0.5 LHSV at 1200 p.s.i.g. of 80% hydrogen (at the reactor inlet). The 2500 SUS oil contained about 270 p.p.m. of basic nitrogen before the hydrorefining. The hydrorefined oil contained about 180 p.p.m. of nitrogen (and about 350 p.p.m. total nitrogen). The UVA of the 2500 SUS distillate before hydrorefining was about 10.8 and, the hydrorefined oil had a 260 UVA of about 5.6, indicating a severe hydrogenation for such a relative highly viscous distillate. The appropriate values for the charge and hydrogenated oil produced from this charge are plotted in FIG. 1.

Example II

FIG. 2 of the drawings illustrates the degree to which the basic nitrogen is a hydrorefined oil can be reduced by contacting the oil with various amounts of an acid-activated clay. The upper curve in FIG. 2 shows the nitrogen levels which were obtained by such contact of the 2500 SUS hydrorefined oil of Example 1. In the figure, the acid clay used had an acidity equivalent to 10.2 mg KOH per gram. In FIG. 2, the basic nitrogen is plotted on a logarithmic scale, indicating that as the lower levels of nitrogen content are approached, it becomes progressively more difficult to remove basic nitrogen with the acid clay adsorbent. The two curves in FIG. 2 illustrate that as the viscosity of the hydrorefined oil increases greater amounts of acid clay are necessary to reduce the basic nitrogen content to less than 10 p.p.m. (and or more preferably to less than 5 p.p.m.). With the more highly viscous, hydrorefined oils it becomes more economical to utilize a mineral acid, and to dilute the oil with a non-reactive, less viscous, lower boiling solvent (such as iso-octane or gas oil). Such contacting with a mineral acid can be by the processes shown in the previously referred to applications Ser. No. 622,398 (now U.S. Pat. No. 3,462,358 or Ser. No. 652,026 (now U.S. Pat. No. 3,502,567). Other preferred processes for removing basic nitrogen from such oils are those shown in the application of Schneider and Stuart, Ser. No. 657,438. Cables containing Kraft paper and the oils containing less than 5 p.p.m. of basic nitrogen show good performance under service conditions, (see Ser. No. 850,779, now U.S. Pat. No. 3,586,752).

Example III

A residuum was obtained from the distillation of 30*a* naphthenic crude (VGC of 0.89) by the caustic distillation process described in U.S. Pat. No. 3,184,396. This residuum was distilled under a lower pressure than that used in the first distillation and a 35 volume % overhead fraction (viscosity 13,000 SUS at 100°F. and 200 SUS at 210°F.) was recovered. This overhead will be referred to hereinafter as "heavy distillate from heavy residuum" or by the abbreviation "HDFHR." The HDFHR was hydrorefined, in the presence of a sulfided Ni-Mo oxide catalyst, at a temperature of about 605°F., 1140 p.s.i.g. total pressure (about 75% $H_2$ at reactor inlet), at a 7 to 1 volume ratio of recycle to charge and with a reactor gas bleed of 18,000 scfh. The hydrogenated product (95 volume % yield) had a viscosity at 100°F. of 8050 SUS and 170 SUS at 210°F. this hydrogenated oil had an initial ASTM color of 2.0 and remained stable in color if stored at temperatures below 130°F. when contacted with 10 lb/bbl. of $H_2SO_4$, washed and neutralized and finished with 10 lb./bbl. of attapulgite. The final oil had an initial power factor (100°C.) of 0.0006 and an aged (with Cu) 100°C. power factor of 0.012.

Table 1 herein reports the additional improvement in electrical properties which can be obtained when the "HDFHR" is treated with an acid such as $H_2SO_4$, washed and neutralized prior to the hydrogenation step. Also shown is the additional improvement which can be obtained by a final contacting with acid-activated clay.

A preferred class of hydrorefined oil of the present invention is characterized by having an ASTM-VI of less than 65 (typically less than 50) and containing at least 20 wt. % aromatics (typically 25–45%). Generally, the Engler viscosity at 20°C. will be greater than 10° (typically, over 15°E). Technical grade white oils, useful as agricultural spray oils, or for blending with the novel oils discussed above, and having viscosities in the range of 50–600 SUS at 100°F. can be made from hydrogenated paraffinic oils when the hydrogenation is effected under the conditions shown in the accompanying FIG. 3 and Table II. Such technical white oils can have improved oxidation stability if they are blended with from 1–10% of unhydrogenated paraffinic distillate (and the resulting blend can be added to the hydrorefined naphthenic and aromatic oils described herein).

Figure 3:
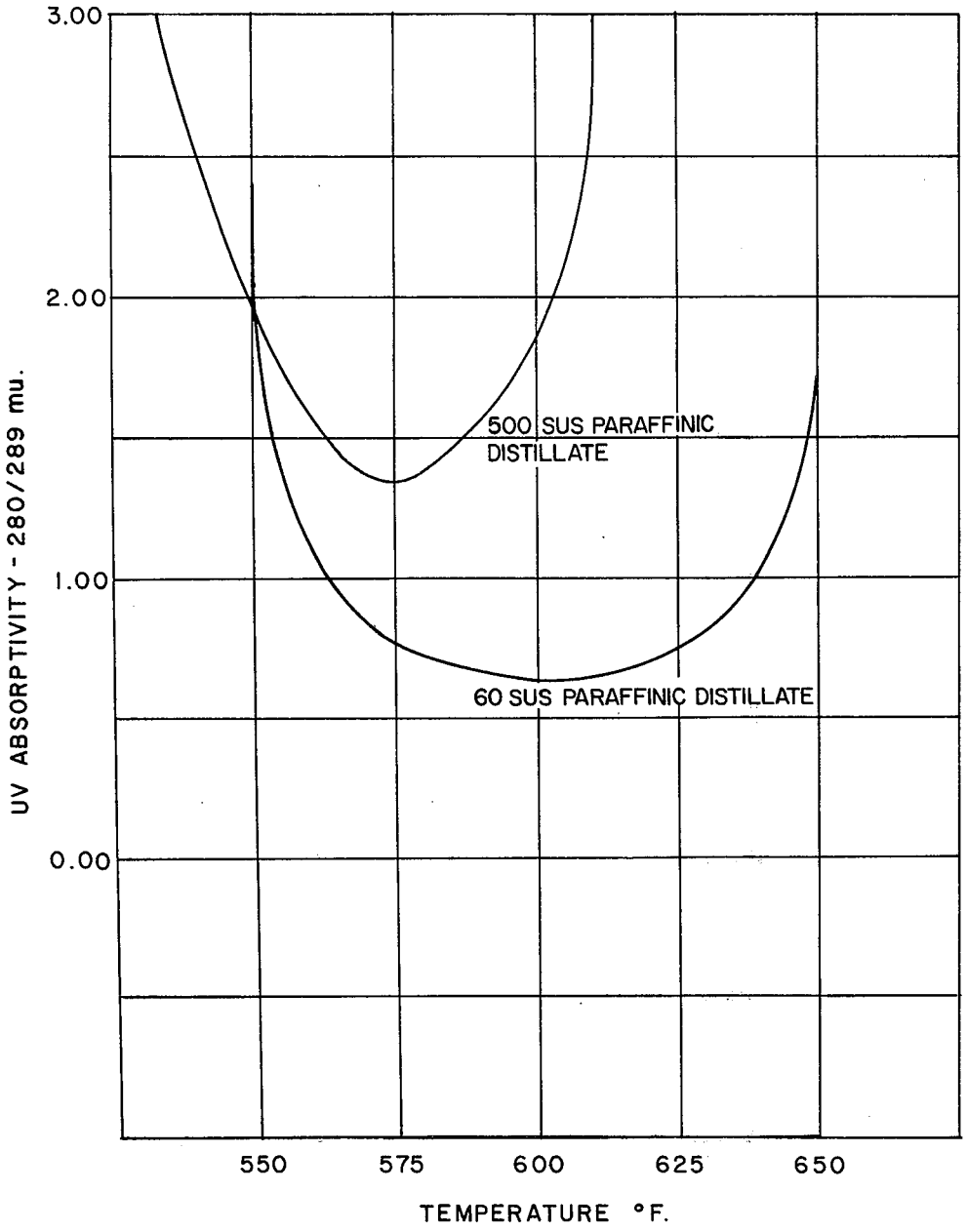

FIG. 3 illustrates the ultraviolet absorptivity in the 280–289 millimicron region for paraffinic distillates of varying viscosities (60 SUS and 500 SUS, respectively). The curves show that within a very narrow temperature range and with the same catalyst as in FIG. 1 the UV absorptivity in the 280–289 millimicron region (280–289 UVA) can be minimized. At a temperature between 550°–600°F., a 500 SUS distillate can be hydrogenated, at 800 p.s.i. or more of hydrogen partial pressure, to produce a technical white oil having a 280–289 UVA less than 2.0. For a 60 SUS paraffinic distillate, a hydrogenation temperature in the range of 565°–640°F. can be used to produce a hydrogenated oil having a 280–289 UVA less than 1.0. At hydrogen pressures in the range of 800–2000 p.s.i., a temperature of about 575°F. (or a range of 565°–585°F) can be used to provide an optimum hydrogenation (as indicated by a low 280–289 UVA) for paraffinic distillates having viscosities in the range of 50–600 SUS at 100°F. Such hydrogenated oils can be advantageously finished with acid-activated or fuller's earth bleaching clays or with mixtures of such clays (5–50 lbs/bbl). Table II herein reports on further properties of such technical white oils.

TABLE I

8800 SUS (at 100°F.) Cable Oils Made from Heavy Distillate from Heavy Residuum (HD-FHR)

| Step | Further Treatment of "HDFHR" | Basic Nitrogen ppm | ASTM Dissination Factor Initial at 100°C. | ASTM Dissination Factor Aged, 4 days Cu, 115°C. |
|---|---|---|---|---|
| 1st | 10 lb/bbl $H_2SO_4$ | | | |
| 2nd | Hydrogenation | 1 | — | 0.0361 |
| 3rd | 10 lb/bbl acid-activated clay | | | |
| 1st | 25 lb/bbl $H_2SO_4$ | | | |
| 2nd | Hydrogenation | 23 | — | — |
| 1st | 225 lb/bbl $H_2SO_4$ | | | |
| 2nd | Hydrogenation | 1 | 0.0002 | 0.0160 |
| 3rd | 10 lb/bbl acid-activated clay | | | |
| 1st | 40 lb/bbl $H_2SO_4$ | | | |
| 2nd | Hydrogenation | 8 | — | — |
| 1st | 40 lb/bbl $H_2SO_4$ | | | |
| 2nd | Hydrogenation | 1 | 0.0001 | 0.0092 |
| 3rd | 10 lb/bbl acid-activated Clay | | | |
| | Commerical Polybutene (2500 SUS at 100°F.) | 1 | 0.0002 max | 0.0021 |

TABLE II

Ultraviolet Absorptivity Data for Hydrogenated Paraffinic Distillates

| Run | Hydrogenation Conditions (1000 psig of 100% $H_2$) Temp°F. | LHSV | FDA Absorptivities, mu 280/209 | 290/299 | 300/329 | 330/350 | UV Absorptivities, mu 260 | 325 | 335 |
|---|---|---|---|---|---|---|---|---|---|
| A[a] | (Charge) | | 10.73 | 8.85 | 7.45 | 3.30 | 0.93 | 0.08 | 0.05 |
| B | 550 | 0.5 | 1.98 | 1.74 | 1.39 | 0.46 | 0.41 | 0.02 | 0.01 |
| C | 575 | 0.5 | 1.36 | 1.14 | 0.90 | 0.34 | 0.32 | 0.02 | 0.01 |

TABLE II-continued

Ultraviolet Absorptivity Data for Hydrogenated Paraffinic Distillates

| Run | Hydrogenation Conditions (1000 psig of 100% $H_2$) Temp°F. | LHSV | FDA Absorptivities, mu 280/209 | 290/299 | 300/329 | 330/350 | UV Absorptivities, mu 260 | 325 | 335 |
|---|---|---|---|---|---|---|---|---|---|
| D | 600 | 0.5 | 1.88 | 1.45 | 1.16 | 0.54 | 0.28 | 0.02 | 0.01 |
| E | 625 | 0.5 | 11.18 | 7.85 | 6.45 | 3.20 | 0.57 | 0.04 | 0.03 |
| F | 650 | 0.5 | 10.35 | 6.95 | 5.62 | 3.70 | 0.32 | 0.03 | 0.02 |
| G | 625 | 0.25 | 5.65 | 3.68 | 2.90 | 2.12 | 0.19 | 0.02 | 0.02 |
| | Spec. FDA Tech. White Oil | | 4.0 | 3.3 | 2.3 | 0.8 | — | — | — |
| H[b] | 650 | 0.5 | 6.41 | 3.32 | 2.60 | 2.60 | — | — | — |
| I[c] | 550 | 0.5 | 0.68 | 0.41 | 0.33 | 0.17 | — | — | — |

[a]500 SUS paraffinic distillate charge hydrogenated at indicated conditions (Runs B-C).
[b]60 SUS at 100°F. paraffinic distillate charge hydrogenated at indicated conditions (Runs H and I).
[c]Sample H (650°F., 0.5 LHSV) rerun at 550°F. 0.5 LHSV (2 stage process).

The invention claimed is:

1. Process for producing a technical white oil having an ultraviolet absorptivity in the 280–289 millimicron region less than 2.0 and having a viscosity in the range of 300–600 SUS at 100°F., said process comprising hydrogenating a paraffinic distillate having a viscosity in the range of 400–600 SUS at a temperature in the range of 550°–600°F., at a hydrogen partial pressure in the range of 800–3000 p.s.i. and a total pressure in the range of 800–6000 p.s.i.g., in the presence of a hydrogenation catalyst consisting essentially of sulfides of nickel and molybdenum on alumina, and at a liquid hourly space velocity in the range of 0.1–1.0.

2. Process according to claim 1 wherein said temperature is about 575°F.

* * * * *